US010233001B2

(12) United States Patent
Furio

(10) Patent No.: US 10,233,001 B2
(45) Date of Patent: Mar. 19, 2019

(54) CONTAINER CARRIER APPARATUS AND METHODS OF MAKING AND USING THE SAME

(71) Applicant: Sante Furio, Chicago, IL (US)

(72) Inventor: Sante Furio, Chicago, IL (US)

( * ) Notice: Subject to any disclaimer, the term of this patent is extended or adjusted under 35 U.S.C. 154(b) by 93 days.

(21) Appl. No.: 15/430,638

(22) Filed: Feb. 13, 2017

(65) Prior Publication Data

US 2017/0355501 A1 Dec. 14, 2017

Related U.S. Application Data

(60) Provisional application No. 62/347,891, filed on Jun. 9, 2016.

(51) Int. Cl.
*B65D 5/355* (2006.01)
*B65D 75/14* (2006.01)
(Continued)

(52) U.S. Cl.
CPC ..... *B65D 75/14* (2013.01); *A45F 5/10* (2013.01); *B65D 5/0005* (2013.01); *B65D 5/4266* (2013.01); *B65D 5/46096* (2013.01); *B65D 5/46104* (2013.01); *B65D 71/125* (2013.01); *B65D 71/38* (2013.01); *B65D 85/70* (2013.01); *A45F 2005/1006* (2013.01); *A45F 2005/1013* (2013.01); *A45F 2200/055* (2013.01);
(Continued)

(58) Field of Classification Search
CPC ..... B65D 5/0005; B65D 5/46104; B65D 5/46136; B65D 5/46168; B65D 5/46112; B65D 5/46144; B65D 5/46176; B65D 5/2004; B65D 5/2009; B65D 5/067; B65D 5/064; B65D 5/066; B65D 5/069; B65D 5/10; B65D 5/103; B65D 5/106; B65D 5/18; B65D 5/202057; B65D 5/2061; B65D 5/325; B65D 5/327; B65D 71/28; B65D 71/30; B65D 71/32; B65D 71/38; B65D 71/0048; B65D 75/14; B65D 75/02; B65D 5/46096
USPC ..... 229/103, 103.2, 103.3, 107, 101, 229/108–116, 123, 148, 130, 117.14, 229/117.15, 128, 149, 150, 155–158
See application file for complete search history.

(56) References Cited

U.S. PATENT DOCUMENTS 789,137 A * 5/1905 Beers ..... B65D 5/46096 206/446
2,004,098 A * 6/1935 Andrews ..... B65D 75/02 206/526
(Continued)

*Primary Examiner* — Christopher R Demeree
*Assistant Examiner* — Nina K Attel
(74) *Attorney, Agent, or Firm* — Scherrer Patent & Trademark Law, P.C.; Stephen T. Sherrer; Monique A. Morneault

(57) ABSTRACT

The present disclosure relates to a carrier apparatus primarily for carrying containers having food products therein; but secondarily for carrying containers having any type of products contained therein. Specifically, the carrier apparatus of the present invention allows a user to transport various amounts and types of containers securely, minimizing disturbance to products, such as food products, contained therein. More specifically, the carrier apparatus of the present invention comprises a first configuration for carrying a first amount of containers and a second configuration for carrying a second amount of containers.

14 Claims, 11 Drawing Sheets

(51) Int. Cl.

| | |
|---|---|
| ***B65D 5/42*** | (2006.01) |
| ***B65D 5/46*** | (2006.01) |
| ***B65D 85/00*** | (2006.01) |
| ***A45F 5/10*** | (2006.01) |
| ***B65D 71/12*** | (2006.01) |
| ***B65D 71/38*** | (2006.01) |
| *B65D 67/00* | (2006.01) |

(52) U.S. Cl.

CPC ..... *B65D 67/00* (2013.01); *B65D 2571/0066* (2013.01); *B65D 2571/00154* (2013.01); *B65D 2571/00456* (2013.01); *B65D 2571/00475* (2013.01); *B65D 2571/00666* (2013.01); *B65D 2571/00796* (2013.01); *B65D 2571/00802* (2013.01)

(56) References Cited

U.S. PATENT DOCUMENTS 2,220,110 A * 11/1940 Layton ..... B65D 5/008 206/551
3,377,015 A * 4/1968 Moreno ..... B65D 5/18 229/110
5,031,824 A * 7/1991 Itey ..... B65D 5/2033 229/110
6,183,027 B1 * 2/2001 Tsao ..... B65D 71/48 206/194
6,298,992 B1 * 10/2001 Tsao ..... B65D 71/48 206/194

* cited by examiner

CONTAINER CARRIER APPARATUS AND METHODS OF MAKING AND USING THE SAME

TECHNICAL FIELD

The present disclosure relates to a carrier apparatus primarily for carrying containers having food products therein; but secondarily for carrying container having any type of products contained therein. Specifically, the carrier apparatus of the present invention allows a user to transport various amounts and types of containers securely, minimizing disturbance to products, such as food products, contained therein. More specifically, the carrier apparatus of the present invention comprises a first configuration for carrying a first amount of containers and a second configuration for carrying a second amount of containers.

BACKGROUND

It is, of course, generally known to utilize carriers to carry products, such as food products. A need, however, exists for a carrier apparatus that allows for the transport of a plurality of different amounts and types of containers. For example, pizzas are known to be transported in square or round cardboard containers, and more specifically, pizza slices are individually contained within triangular "slice"-shaped cardboard containers. Packaging individual slices may be desired where hungry people wish to each have their own pizza slice that may be different than the others. Indeed, it is often the case that individuals wish to have a pizza slice having toppings specific to their tastes, without having to compromise by ordering a full pizza in which everyone can agree.

Commonly, a flexible bag is often used to carry one or more containers for products, such as food products. However, flexible bags do not provide sufficient rigidity and strength to ensure that containers maintain their upright position so as not to upset the products contained therein. Carrying a flexible bag containing product containers therein is often difficult and awkward, and if handled incorrectly, may upend products contained therein. Moreover, flexible bags do not provide a clean, flat surface for graphics, logos, advertising, etc. that may be clearly discerned by a user. A need, therefore, exists for a carrier apparatus that maintains product containers in desired upright positions so as not to upset products contained therein. Further, a need exists for a carrier apparatus that includes a flat surface for presentation of graphics, logos, advertising, or other like indicia.

While it may be relatively easy to transport a single full pizza within a relatively large pizza box, it may be difficult to easily and securely carry and transport a plurality of pizza slice containers in the same manner. A need, therefore, exists for a carrier apparatus designed specifically to carry one or more pizza slice containers securely and safely. In addition, individuals may desire to order one or more pizza slices and other food products, such as salads, garlic bread, cheeses, spices, sauces, and other like products. Likewise, individuals may further desired to further transport utensils, napkins, wipes, and other like non-food products with their food. A need, therefore, exists for a carrier apparatus that allows for the safe and secure transport of different kinds of food products together, or food products and non-food products at the same time.

Likewise, other food products are also difficult to transport, and a need exists for a carrier apparatus that maintains products, such as food products, within individual containers in an upright position without tipping. Oftentimes, individual pizzas, such as single serve pizzas, deep dish pizza pies, bakery pies, cakes, cupcakes, and other like products may be packaged in cardboard containers for transport, and it is often desired to maintain these products in a certain position or orientation to avoid damage to the food products. A need, therefore, exists for a carrier apparatus that easily and effectively maintains products contained therein in upright desired position or orientation. Specifically, a need exists for a carrier apparatus that minimizes or even prevents damage to products, such as food products, within containers during transport of the same.

It is further often difficult to transport a plurality of containers at the same time when the containers are of different shapes and/or sizes. Specifically, in the example above, a user may order a pizza slice that may be contained within a triangular-shaped pizza slice container, and a salad, pie, cake or other food product that may be contained within a square container. Likewise, a user may order another product, whether a food product or otherwise, that may be contained in a round container. A need exists for a carrier apparatus that can effectively and securely carry and transport a plurality of containers of different types and sizes, such as triangular-shaped, square, round, or other geometric shape, at the same time using one or more carrier apparatuses. More specifically, a need exists for a carrier apparatus that allows a user to mix and match different types and sizes of containers depending on the products transported therein.

Moreover, a need exists for a carrier apparatus that is easy to manufacture using inexpensive materials. Specifically, a need exists for a method of making a carrier apparatus that is easily manufactured for one or more specific types and/or sizes of containers. More specifically, a need exists for a method of using a carrier apparatus that allows a user to adopt a first configuration for a first amount and/or type of containers, and/or adopt a second configuration for a second amount and/or type of containers.

SUMMARY OF THE INVENTION

The present disclosure relates to a carrier apparatus primarily for carrying containers having food products therein; but secondarily for carrying containers having any type of products contained therein. Specifically, the carrier apparatus of the present invention allows a user to transport various amounts and types of containers securely, minimizing disturbance to products, such as food products, contained therein. More specifically, the carrier apparatus of the present invention comprises a first configuration for carrying a first amount of containers and a second configuration for carrying a second amount of containers.

To this end, in an embodiment of the present invention, a carrier apparatus is provided. The carrier apparatus comprises a base section, a first wing, a second wing, and an extended slotted lock flap, wherein the first wing and the second wing are foldable along a first set of fold lines wherein folding at the first set of fold lines and engaging with the extended slotted lock flap in a first location forms a first internal space having a first volume, and a second set of fold lines, wherein folding at the second set of fold lines and engaging with the slotted lock flap in a second location forms a second internal space having a second volume. In an embodiment, the carrier apparatus comprises three wings. In an embodiment, the carrier apparatus comprises four wings.

It is, therefore, an advantage and objective of the present invention to provide a carrier apparatus that allows for the transport of a plurality of different amounts and types of containers.

More specifically, it is an advantage and objective of the present invention to provide a carrier apparatus designed specifically to carry one or more pizza slice containers securely and safely.

Generally, it is an advantage and objective of the present invention to provide a carrier apparatus that allows for the safe and secure transport of different kinds of food products together, or food products and non-food products at the same time.

Still further, it is an advantage and objective of the present invention to provide a carrier apparatus that includes a flat surface for presentation of graphics, logos, advertising, or other like indicia.

Moreover, it is an advantage and objective of the present invention to provide a carrier apparatus that easily and effectively maintains products contained therein in an upright position.

Specifically, it is an advantage and objective of the present invention to provide a carrier apparatus that minimizes or even prevents damage to products, such as food products, within containers during transport of the same.

In addition, it is an advantage and objective of the present invention to provide a carrier apparatus that can effectively and securely carry and transport a plurality of containers of different types and sizes.

More specifically, it is an advantage and objective of the present invention to provide a carrier apparatus that allows a user to mix and match different types and sizes of containers depending on the products transported therein.

Moreover, it is an advantage and objective of the present invention to provide a carrier apparatus that is easy to manufacture using inexpensive materials.

Specifically, it is an advantage and objective of the present invention to provide a method of making a carrier apparatus that is easily manufactured for one or more specific types and/or sizes of containers.

More specifically, it is an advantage and objective of the present invention to provide a method of using a carrier apparatus that allows a user to adopt a first configuration for a first amount and/or type of containers, and/or adopt a second configuration for a second amount and/or type of containers.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present disclosure relates to a carrier apparatus primarily for carrying containers having food products therein; but secondarily for carrying containers having any type of products contained therein. Specifically, the carrier apparatus of the present invention allows a user to transport various amounts and types of containers securely, minimizing disturbance to products, such as food products, contained therein. More specifically, the carrier apparatus of the present invention comprises a first configuration for carrying a first amount of containers and a second configuration for carrying a second amount of containers.

Figure 1:
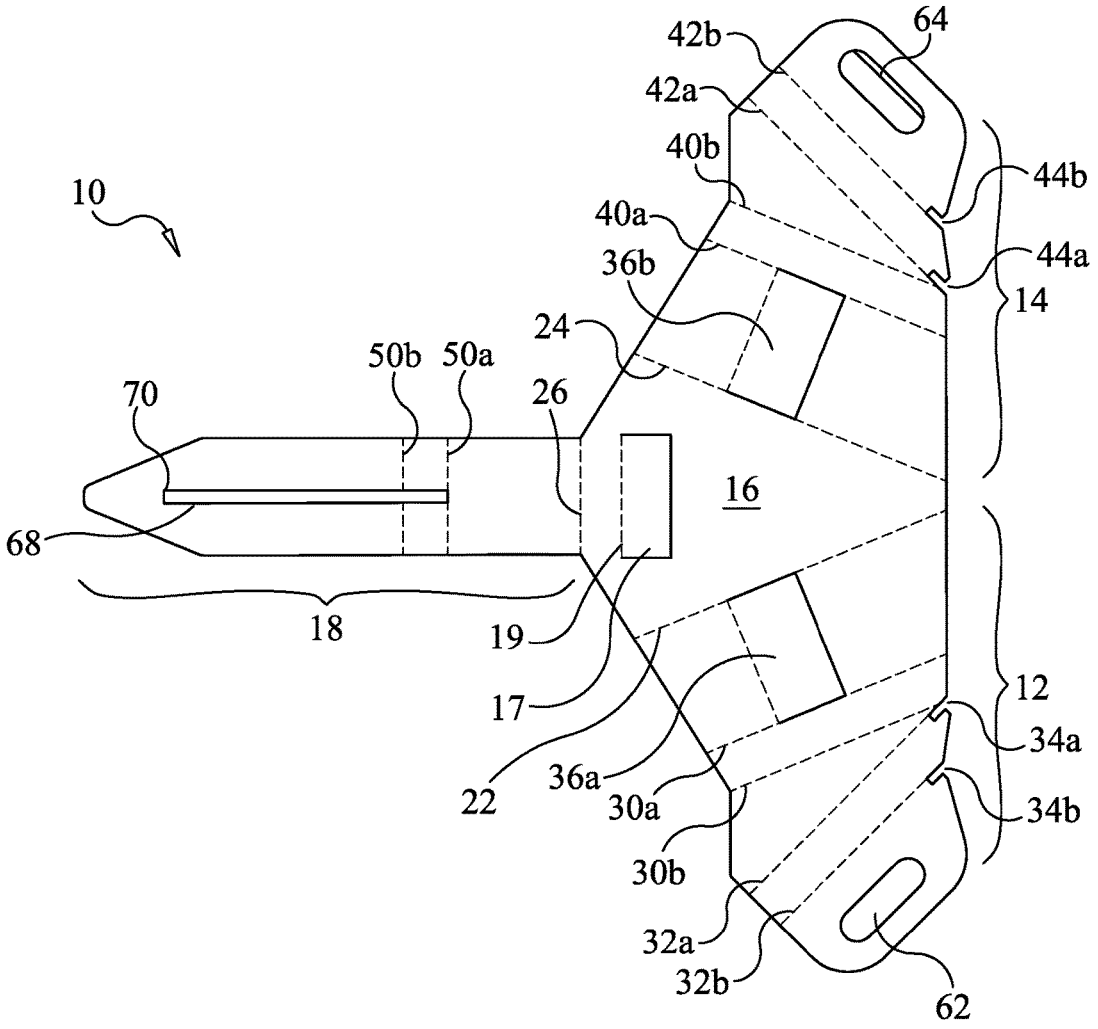
FIG. 1 illustrates a top view of a carrier apparatus 10 in an unassembled configuration in an embodiment of the present invention.

Referring now to the figures, wherein like numerals refer to like parts, FIG. 1 illustrates a top view of a carrier apparatus 10 in an unfolded, or flat, unassembled configuration, such as how the carrier apparatus 10 may exit a die-cutting machine or other like machine of manufacture. Specifically, the carrier apparatus 10, in a preferred embodiment, may be made from a single piece of flat material, such as, preferably, corrugated fiberboard, cardboard, card stock, or other like material, although any material may be utilized as apparent to one of ordinary skill in the art, such as plastic, metal, wood, wood pulp, composite material, or other like material, and the present invention should not be limited as described herein. The carrier apparatus 10 may be utilized, as apparent in the following figures, to hold and transport containers that are triangular in shape, preferably, or square in shape, as described herein, although the carrier apparatuses described herein may be formed to hold any shaped-containers.

The carrier apparatus 10 may comprise a first wing 12 and a second wing 14 that may extend outwardly from two sides, respectively, of a triangular-shaped main body portion 16, and an extending flap 18 that may extend from the third side of the triangular-shaped main body portion 16. The first wing 12 may be folded upwardly from the main body portion 16 via fold line 22 that may be disposed on a first side of the triangular-shaped main body portion 16. The second wing 14 may be folded upwardly from the main body portion 16 via fold line 24 that may be disposed on a second side of the triangular-shaped main body portion 16. Finally, the extending flap 18 may be folded upwardly from the main body portion 16 via fold line 26 that may be disposed on a third side of the triangular-shaped main body portion 16. The first wing 12, the second wing 14 and the extending flap 18 may work in conjunction to form an internal space thereby encasing a container that may be disposed therein, as described in more detail below.

The first wing 12, the second wing 14, and the extending flap 18 may have a plurality of fold lines that provide optional configurations for holding and transporting a first quantity of containers or a second quantity of containers. Specifically, first wing 12 may comprise fold lines 30*a*, 30*b* and 32*a*, 32*b* that optionally are used depending on the quantity of containers within the carrier apparatus 10 when in a fully folded, assembled configuration. Likewise, second wing 14 may comprise fold lines 40*a*, 40*b* and 42*a*, 42*b* that optionally are used depending on the quantity of containers within the carrier apparatus 10 when in a fully folded, assembled configuration. Finally, extending flap 18 may comprise fold lines 50*a*, 50*b* that optionally are used depending on the quantity of containers within the carrier apparatus 10.

Figure 2:
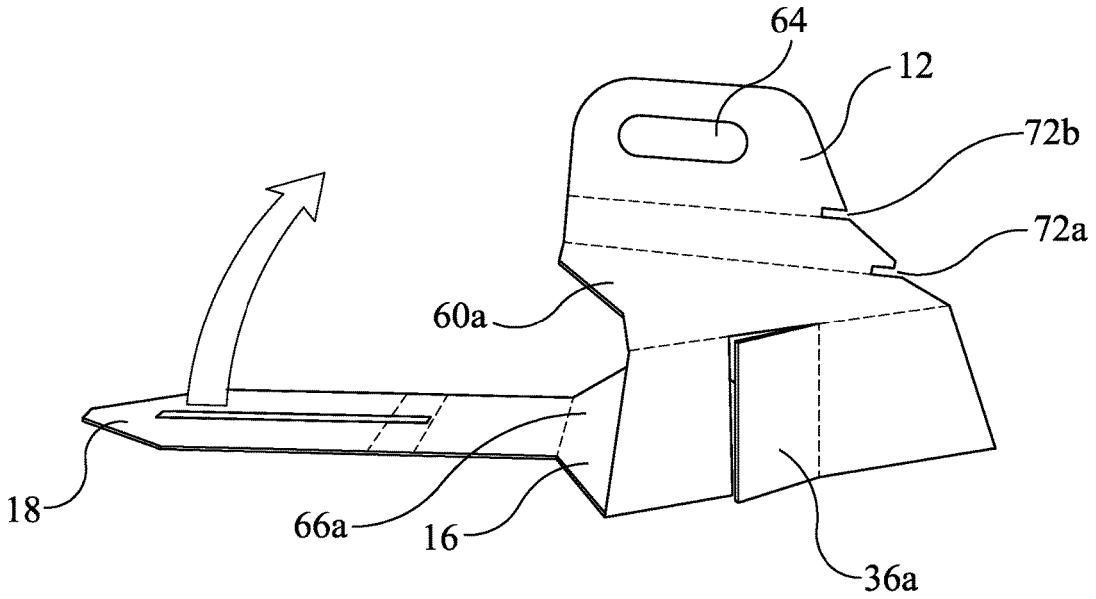
FIG. 2 illustrates a carrier apparatus in a partially formed first configuration in an embodiment of the present invention.
Figure 3:
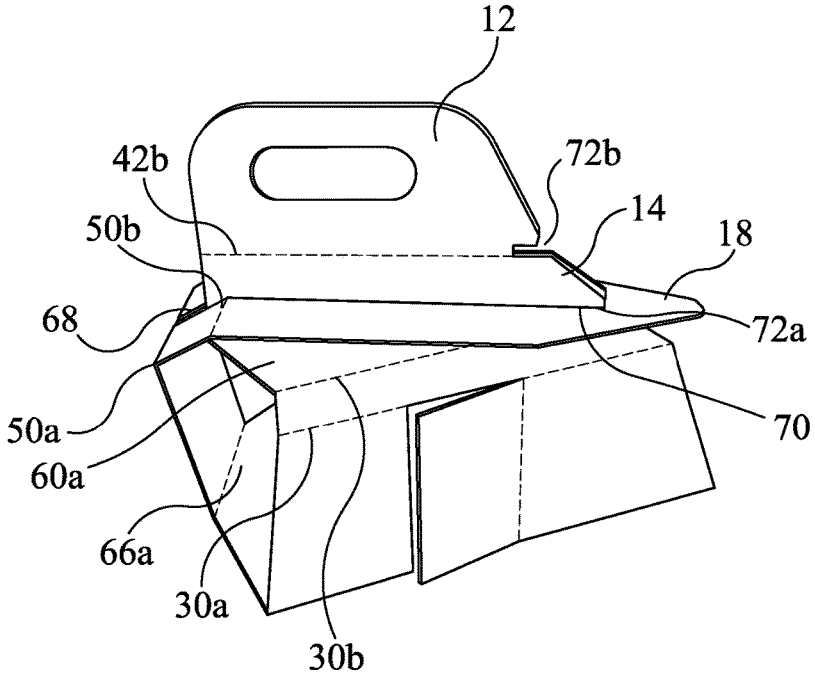
FIG. 3 illustrates a carrier apparatus in a fully formed first configuration in an embodiment of the present invention.
Figure 4:
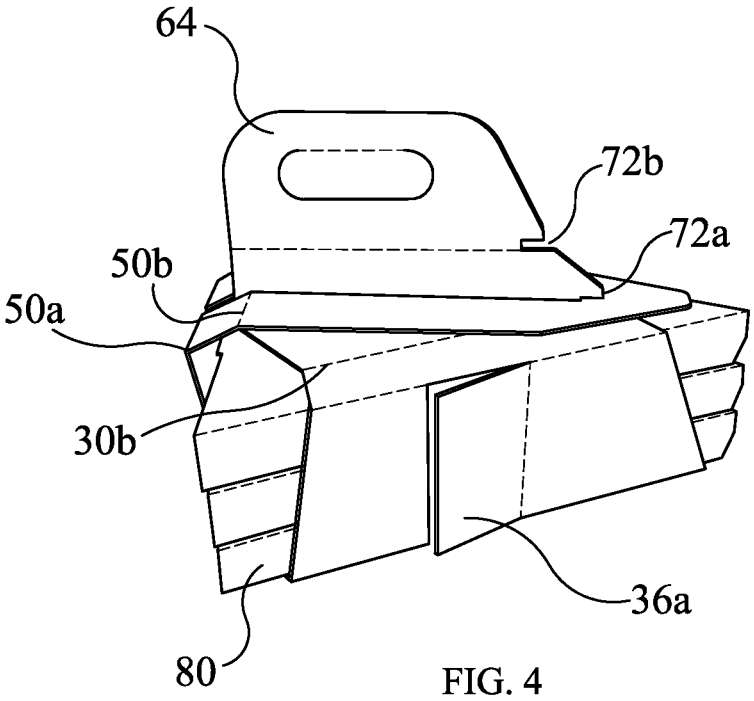
FIG. 4 illustrates a carrier apparatus having containers therein in a first configuration in an embodiment of the present invention.

In a first configuration, shown in FIGS. 2-4, the first and second wings 12, 14 may be folded upwardly relative to the main body portion 16. As illustrated in FIGS. 2-4, only first wing 12 is illustrated, but it should be noted that second wing 14 may also be folded upwardly to mirror the first wing 12. In the first configuration, the first wing 12 may be folded along fold line 30*a* and the second wing may be folded along fold line 40*a* inwardly and parallel with the main body portion 16 to form a top 60*a* for the carrier apparatus 10. The first and second wings 12, 14 may converge in the center of the top 60*a*, and may further be folded along fold lines 32*a*, 42*a* so that the remaining portions of the first and second wings 12, 14 are disposed upwardly and adjacent each other.

First wing 12 may comprise a handle slot 62, and second wing 14 may comprise a foldable handle portion 64. When the remaining portions of the first and second wings 12, 14 converge and are disposed together upwardly, the foldable handle portion 64 may be pushed within the handle slot 62, and folded therewith to hold the adjacent and upwardly extending remaining portions of the first and second wings together, as illustrated in FIG. 2.

The first and second wings 12, 14 thus form an interior space 66*a* in which a plurality of containers may be placed, as illustrated in FIG. 4. Once containers (not shown in FIGS. 2-3) are placed therein, extending flap 18 may be folded upwardly, and slot 68 within extending flap 18 may be disposed over the remaining portions of the first and second wings 12, 14 such that the remaining portions 12, 14 are disposed through the slot 68 of the extending flap 18.

When the first and second wings 12, 14 are disposed adjacent each other and upwardly, as illustrated in FIG. 2, a first engaging end 70 of the extending flap may engage one of two catch slots 72*a*, 72*b* that may be formed when the first and second wings 12, 14 come together. Specifically, catch slot 72*a* may be formed from slot 34*a* and 44*a* of the first and second wings 12, 14, respectively, and catch slot 72*b* may be formed from slot 34*b* and 44*b* of the first and second wings 12, 14, respectively. Extending flap 18 may therefore be folded at fold line 50*a*, as illustrated in FIG. 3, to enclose the interior space 66*a*. Further, as illustrated in FIG. 3, the extending flap 18 is shown disposed over the first and second wings 12, 14 such that the first and second wings 12, 14 are disposed through the slot 68 in the extending slot, and the first end 70 of the slot 68 is engaged with the catch slot 72*a*.

In the first configuration, the interior space 66*a* may have a size and a shape to hold a first plurality of containers. As illustrated in FIG. 4, the interior space 66*a* is shown to hold three pizza slice containers 80. The interior space 66*a* may have the shape and volume of a triangular prism to hold the plurality of triangular-shaped containers therein. Because fold lines 30*a*, 40*a*, 32*a*, 42*a* and 50*a*, and catch slot 72*a*, are utilized, the interior space 66*a* may have a configuration to hold snugly and securely the plurality of pizza slice containers 80, as needed. In the first configuration, fold lines 30*b*, 40*b*, 32*b*, 42*b* and 50*b* are not used.

Figure 5:
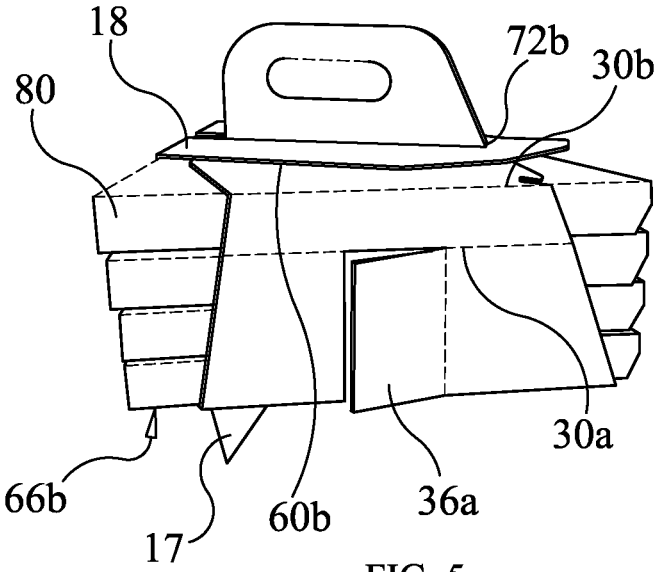
FIG. 5 illustrates a carrier apparatus having containers therein in a second configuration in an embodiment of the present invention.

In a second configuration, illustrated in FIG. 5, fold lines 30*b*, 40*b*, 32*b*, 42*b*, and 50*b*, and catch slot 72*b* may be utilized to form an interior space 66*b* that may be larger than the interior space 66*a*, as described above and shown in FIGS. 2-4. Specifically, in the second configuration, fold lines 30*a*, 40*a*, 32*a*, 42*a* and 50*a*, as well as catch slot 72*a*, are not used. The interior space 66*b*, therefore, is larger in volume than the interior space 66*a* and can thus hold a different quantity of containers therein. For example, as illustrated in FIG. 5, the interior space 66*b* can hold four pizza slice containers 80 instead of just three, as illustrated in FIG. 4. The interior space 66*b* further has a top 60*b* formed from the first and second wings 12, 14, respectively, that is formed by different portions of the first and second wings 12, 14. Moreover, the first engaging end 70 of the extending flap 18 may engage catch slot 72*b* as opposed to catch slot 72*a*. Therefore, the second configuration may hold a different quantity of containers therein than the first configuration.

Figure 6:
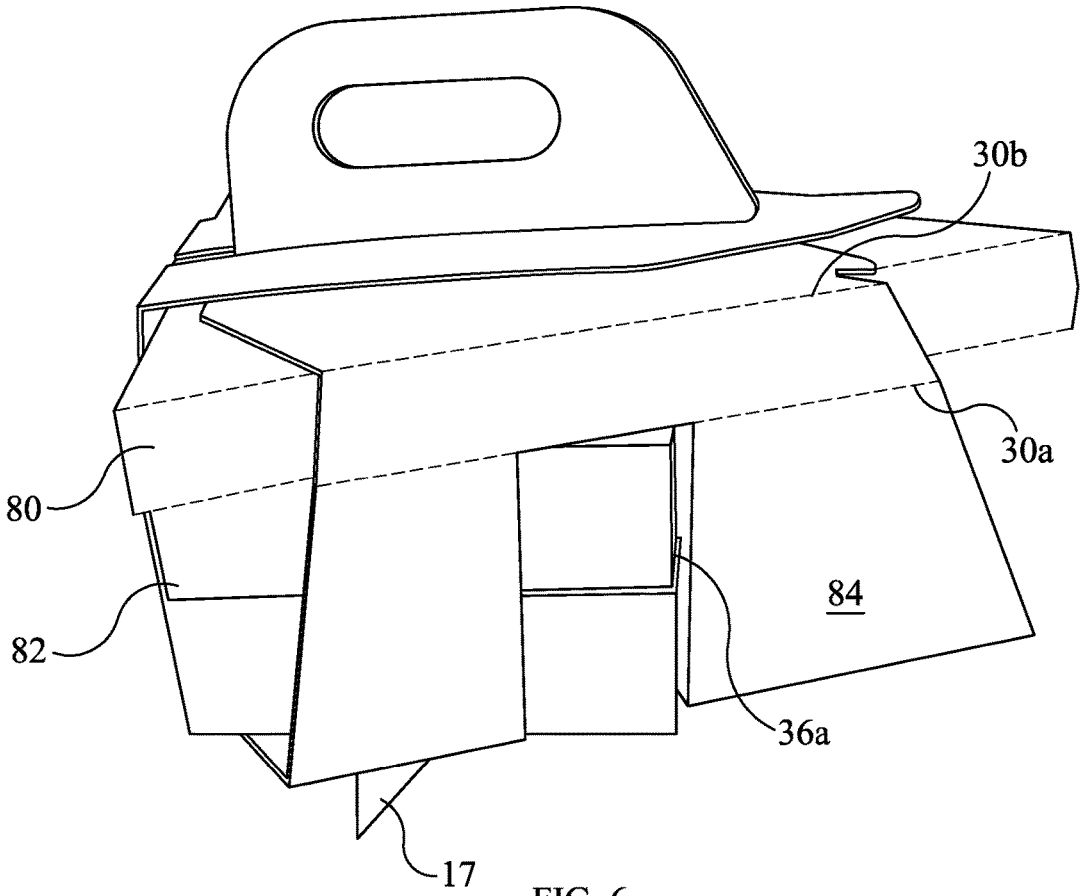
FIG. 6 illustrates a carrier apparatus having different sizes and types of containers therein in a second configuration in an embodiment of the present invention.
Figure 7:
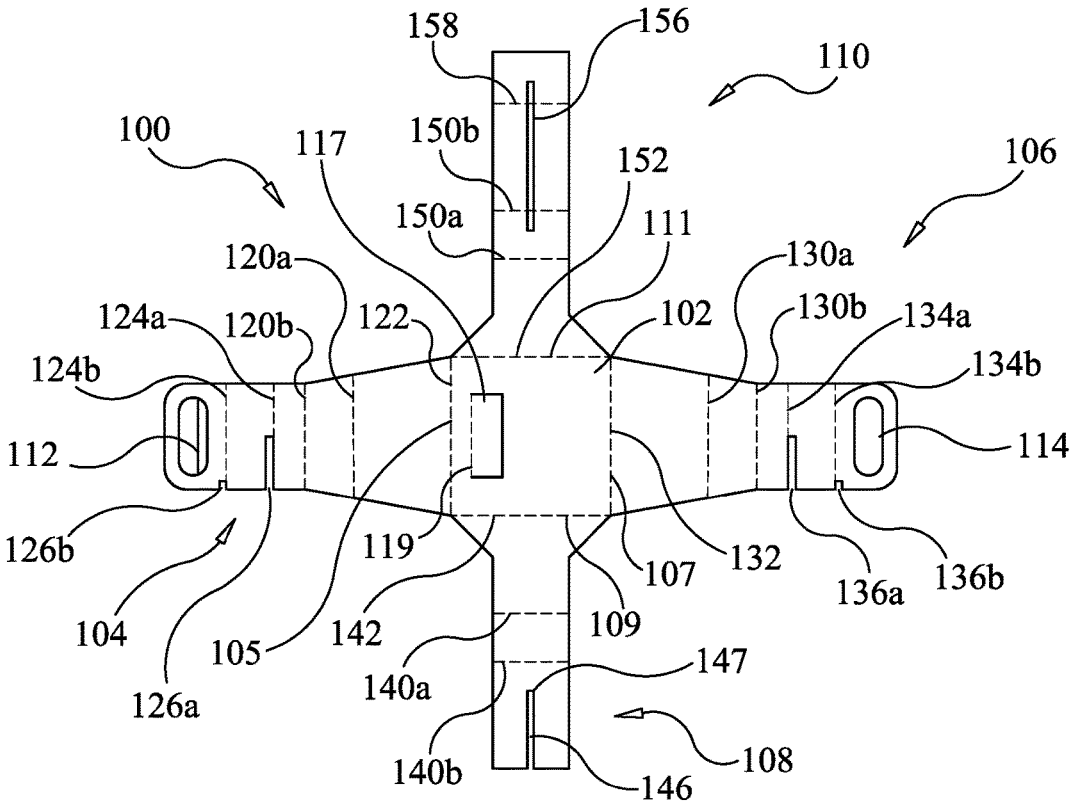
FIG. 7 illustrates a top view of a carrier apparatus in an unassembled configuration in an alternate embodiment of the present invention.

First and second wings 12, 14 may further have side flaps 36*a*, 36*b* that may be folded inwardly, as illustrated in FIG. 6, or otherwise removed to provide spaces 38*a*, 38*b* in the first and second wings 12, 14. The spaces 38*a*, 38*b* may allow corners of one or more square containers 82 to be disposed therethrough so that the interior spaces 66*a* and 66*b* may hold the square containers 82 snugly and securely. An additional interior space 84 may be formed in front of the square containers 82 that may be utilized for holding items, such as condiments, utensils, and the like.

Therefore, as illustrated in FIGS. 4-6, the carrier apparatus 10 may be alternately configured to hold a first quantity of containers, a second quantity of containers, or a mix of types of containers, such as triangular-shaped containers and square containers. The containers may contain any product, such as, preferably, food products like pizza slices, salads, garlic bread, desserts, such as pies, cakes, cupcakes, or other like food products. Moreover, the carrier apparatus 10 may further have spaces disposed around the various parts thereof that may be printed thereon with advertising, instructions, graphics, text, or other like indicia, as apparent to one of ordinary skill in the art.

Referring again to FIG. 1, the carrier apparatus 10 may have a flap 17 or a plurality of flaps disposed in the main body portion 16 that may extend downwardly from the main body portion 16 to form a leg or prop for the carrier apparatus 10, as illustrated in FIGS. 5 and 6, so that the carrier apparatus 10 may be set on an inclined surface and yet still maintain a horizontal disposition. Therefore, any items contained within containers carried by the carrier apparatus 10 may not slide due to gravity, and may therefore maintain their positions within the containers. For example, the carrier apparatus 10 may contain a plurality of pizza slice containers having pizza slices contained therein. The carrier apparatus 10 may be placed on an automobile seat that may have a generally inclined surface. By extended the flap 16 from the main body portion along fold line 17, the flap 16 may act as a leg or prop to maintain the pizza slices within the containers in a generally horizontal configuration, preventing the pizza sliced from sliding and causing damage to the pizza slices.

Now referring to FIGS. 7-11, an alternate embodiment of a carrier apparatus 100 is shown and described herein. The carrier apparatus 100 is similar to the carrier apparatus 10, as described above and shown in FIGS. 1-6, except the carrier apparatus 100 is primarily designed to hold square, rectangular or round containers therein. The carrier apparatus 100 comprises a square-shaped base portion 102, a first wing 104 extending from a first side 105 of the square-shaped base portion 102, a second wing 106 extending from a second side 107 of the square-shaped base portion 102 opposite the first side 105, a third wing 108 extending from a third side 109 of the square-shaped base portion 102, and a fourth wing 110 extending from a fourth side 111 of the square-shaped base portion 102 opposite the third side 109. Each of the wings 102, 104, 106, 108 may have a plurality of fold lines for forming a first or a second internal space, as disclosed in more detail below.

Figure 8:
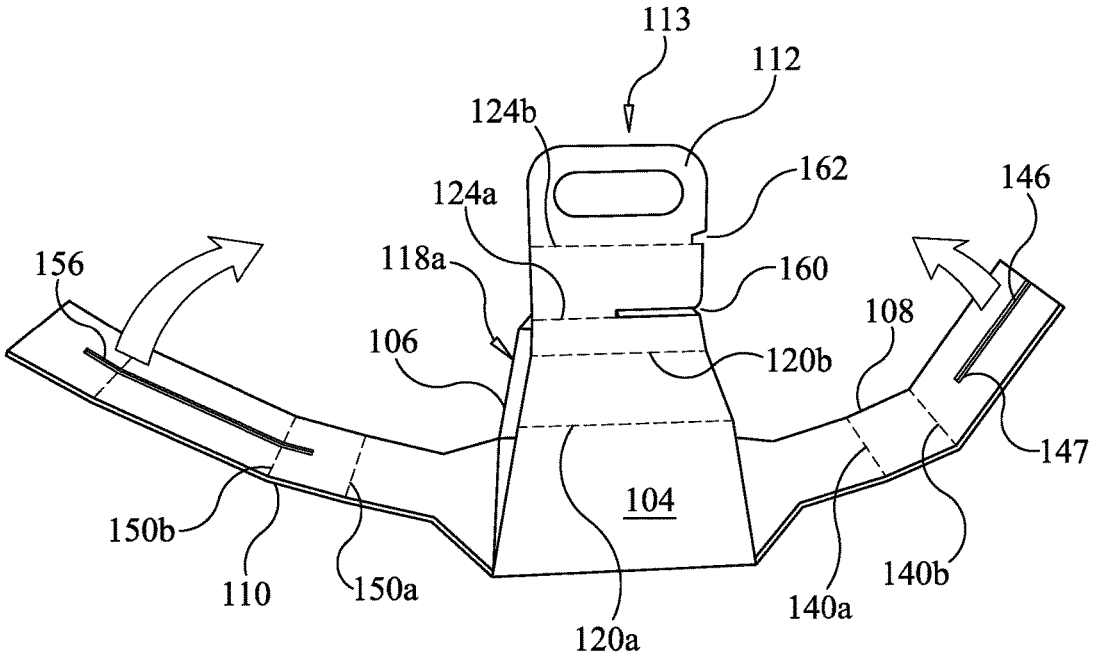
FIG. 8 illustrates a carrier apparatus in a partially formed first configuration in an alternate embodiment of the present invention.

The first wing 104 may have a first handle portion 112 on an end thereof, and the second wing 106 may have a second handle portion 114 on an end thereof, such that the first wing 104 and the second wing 106 may fold in a manner to be adjacent each other so that the first and second handle portions 112, 114 align together forming a handle 113, as illustrated in FIG. 8. The first wing 104 may have a first fold line 120*a* and a second fold line 120*b* at different locations on the first wing 104. Likewise, the second wing 106 may have a first fold line 130*a* and a second fold line 130*b* at different locations on the second wing 106. The third wing 108 may further have a first fold line 140*a* and a second fold line 140*b* at different locations on the third wing 108. And the fourth wing 110 may have a first fold line 150*a*, a second fold line 150*b* and a third fold line 158 at different locations on the fourth wing 110.

Each of the first, second, third and fourth wings 102, 104, 106, 108 may have a fold line 122, 132, 142, 152, respectively, disposed at the first, second, third and fourth sides 105, 107, 109, 111, respectively, of the square-shaped base portion 102. The fold lines 122, 132, 142, 152 allow each of the wings 104, 106, 108, 110 to fold upwardly and form sides for an internal space 118*a* or 118*b*, as illustrated in FIGS. 8-11.

Figure 9:
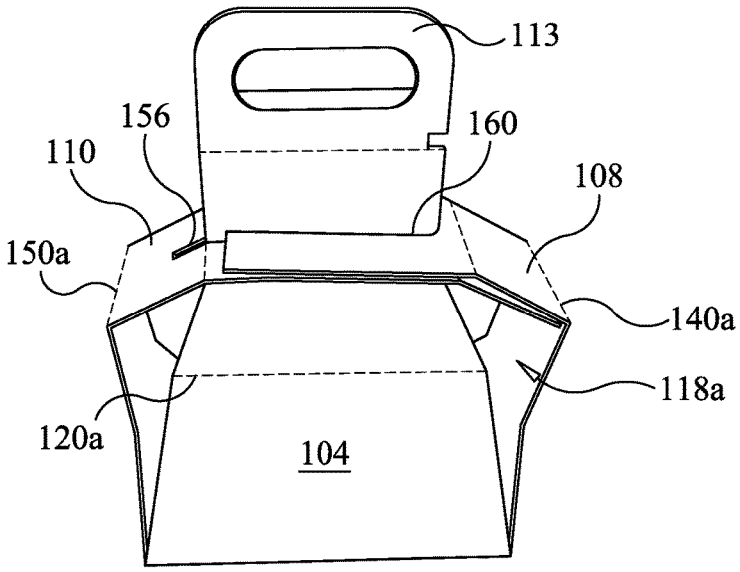
FIG. 9 illustrates a carrier apparatus in a partially formed first configuration in an alternate embodiment of the present invention.
Figure 10:
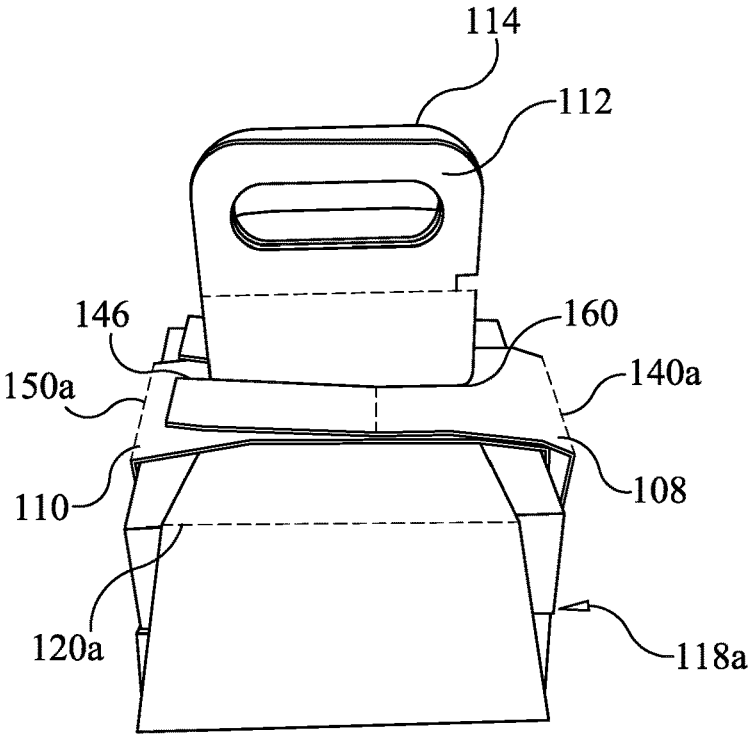
FIG. 10 illustrates a carrier apparatus in a fully formed first configuration in an alternate embodiment of the present invention.
Figure 11:
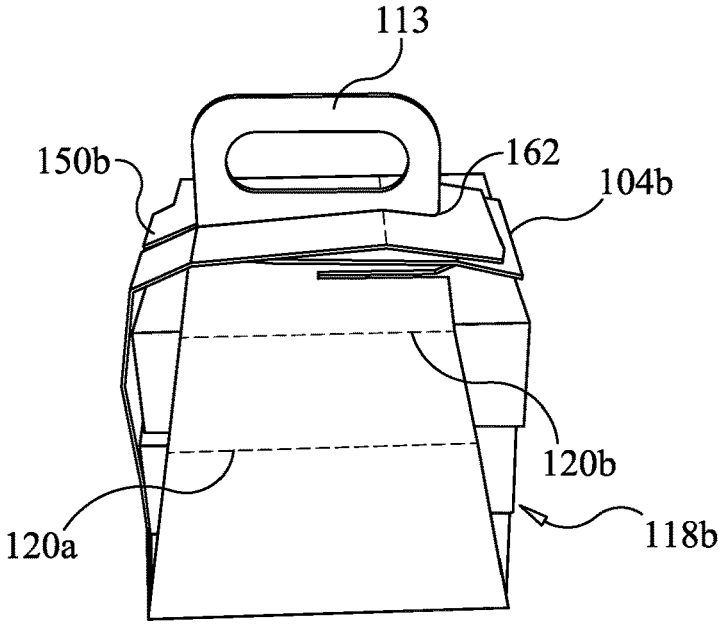
FIG. 11 illustrates a carrier apparatus in a fully formed second configuration in an alternate embodiment of the present invention.

More specifically, the carrier apparatus 100 may be configured to have either a first internal space 118*a* or a second internal space 118*b* (as shown in FIG. 11), depending on whether fold lines 120*a*, 130*a*, 140*a*, 150*a* are used, or whether fold lines 120*b*, 130*b*, 140*b*, 150*b* are used. If fold lines 120*a*, 130*a*, 140*a*, 150*a* are folded, as shown in FIGS. 9-10, then the internal space 118*a* may be formed. If fold lines 1220*b*, 130*b*, 140*b*, 150*b* are folded, as shown in FIG. 11, then internal space 118*b* may be formed. Internal space 118*b* has a greater height than the internal space 118*a* forming a greater volume, allowing for one or more additional containers to be placed therein, as illustrated in FIG. 11.

As illustrated in FIGS. 8-9, the first and second wings 104, 106 may be folded upwardly from the base section 102, and, for forming internal space 118*a*, the first and second wings 104, 106 may be folded at fold lines 120*a* and 130*a*. The first wing 104 may further have a fold line 124*a* and the second wing 106 may have a fold line 134*a* that may be folded so that the first and second wings 104, 106 may be disposed upwardly where the first and second wings 104, 106 converge. Thus, handle portions 112, 114 may be disposed adjacent each other, and together may form the handle 113 that may be used by a user to carry the carrier apparatus 100. In addition, first wing 104 may have an open-ended first slot 126*a* and an open-ended second slot 126*b* disposed at different locations on the first wing 104. Likewise, the second wing 104 may have an open-ended first slot 136*a* and an open-ended second slot 136*b* disposed at different locations on the second wing 106. When the first and second wings 104, 106 converge, the first open-ended slots 126*a*, 136*a* may align together to form first catch slot 160, and second open-ended slots 126*b*, 136*b* may align together to form second catch slot 162, as illustrated in FIGS. 8-11.

As illustrated in FIG. 9, third wing 108 and fourth wing 110 may be folded upwardly at fold lines 142, 152, respectively, to form the remaining two sides of the internal space 118*a* (or 118*b*, as shown in FIG. 11). Third wing 108 may contain an open-ended slot 146 disposed therein that may extend to the terminal end of the third wing 108, and fourth wing 110 may contain a closed slot 156 that may extend between the ends of the fourth wing 110.

To form internal space 118*a*, the third wing 108 may be folded at fold line 140*a* and fourth wing 110 may be folded at fold line 150*a*. Preferably, the fourth wing 110 is folded first, and disposed over the handle 113 so that the handle 113 and portion of first and second wings 104, 106 are disposed through the closed slot 156. Fourth wing 108 may further have a fold line 158 that may be folded downwardly adjacent to a container within internal space 118*a*, as illustrated in FIG. 10. After fourth wing 110 is disposed in the manner described above, the third wing 108 may be folded at fold line 140*a* such that the handle 113 is disposed through open-ended slot 146. Open-ended slot 146 may be disposed through catch slot 160, and may further have an engaging end 147 that may catch in catch slot 160, as illustrated in FIG. 10 to fully form the internal space 118*a* for one or a plurality of containers. As illustrated in FIG. 10, the internal space 118*a* may have sufficient room for two square containers, although it should be noted that the internal space 118*a* may be sized in any manner to hold any number of desired containers, as needed.

Importantly, internal space 118*b* may be formed in a similar manner, and because internal space 118*b* is larger, may be used to hold more containers therein as compared to internal space 118*a*. To form internal space 118*b*, first and second wings 104, 106 may be folded at fold lines 120*b*, 130*b*, respectively, instead of at fold lines 120*a*, 130*a* as described above to form internal space 118*a*. In addition, fold lines 124*b*, 134*b* of first and second wings 104, 106 may be folded, instead of fold lines 124*a*, 134*a*, as described above, to form handle 113.

Likewise, third and fourth wings 108, 110 may be folded at fold lines 140*b*, 150*b*, respectively, instead of fold lines 140*a*, 150*a* as described above. Preferably, and as illustrated in FIG. 11, third wing 108 may first be disposed over handle 113, such that the handle 113 is disposed through the open-ended slot 146 prior to folding and disposing fourth wing 110 thereon. Thus, open-ended slot 146 may be disposed through and engaging end 147 may engage with catch slot 162 instead of catch slot 160. Next, fourth wing 110 may be disposed over handle 113 such that the handle 113 is disposed within slot 156, thereby fully forming internal space 118*b*. As illustrated in FIG. 11, internal space 118*b* may be larger than internal space 118*a* and may hold more containers than internal space 118*a*. Specifically, as illustrated in FIG. 11, internal space 118*b* may hold three containers, whereas internal space 118*a* may hold only two containers, securely. Of course, it should be noted that the internal spaces 118*a*, 118*b* may be designed to hold any number of containers. Further, although containers shown in FIGS. 10 and 11 are square, round containers or containers of other shapes may also be snugly contained therein.

Figure 12:
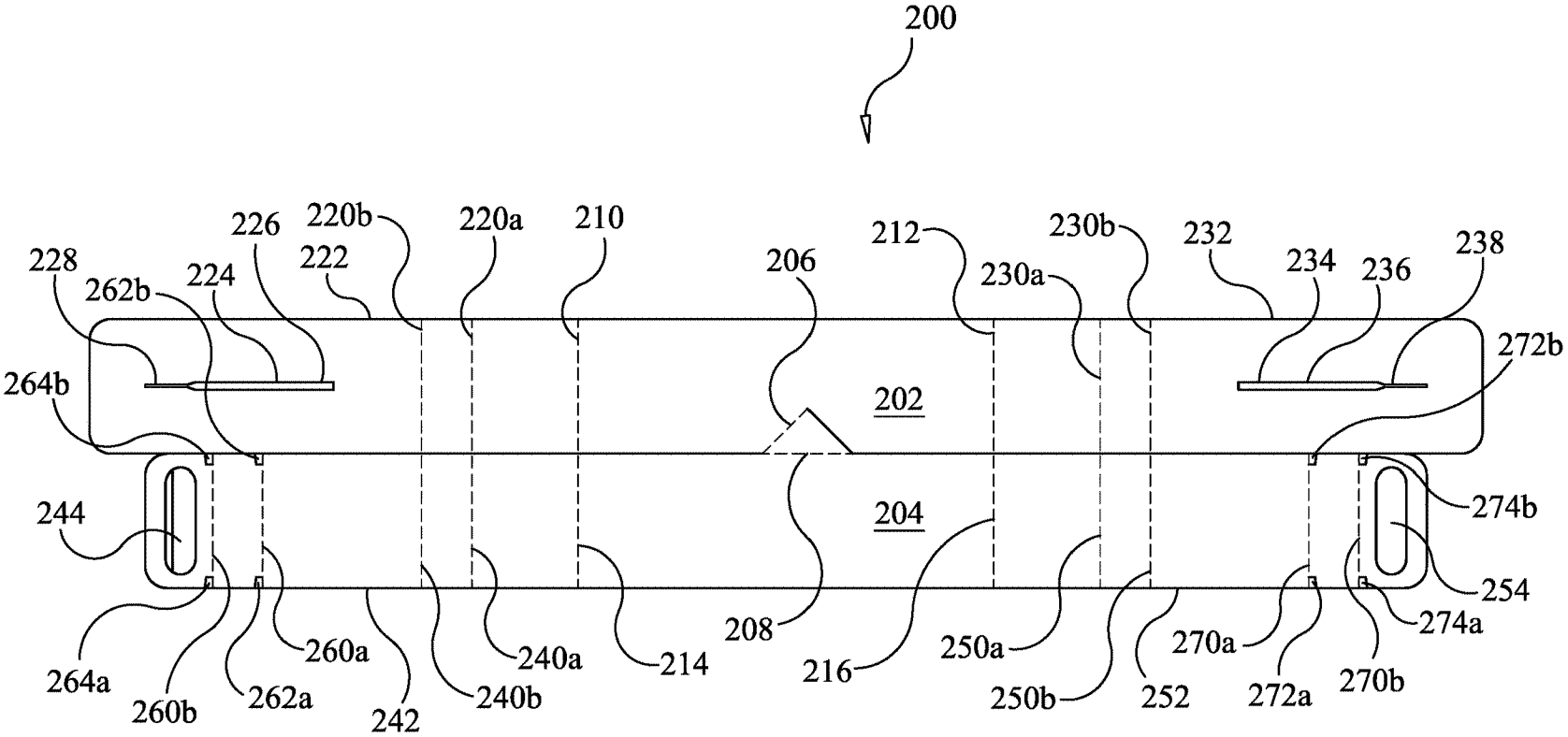
FIG. 12 illustrates a carrier apparatus in an unassembled configuration in an alternate embodiment of the present invention.

Now referring to FIGS. 12 and 13A-13F, an alternate embodiment of the present invention is shown and described herein. Specifically, FIG. 12 illustrates a plan view of a carrier apparatus 200 in a flat and unconstructed configuration. The carrier apparatus 200 may have a first body 202 and a second body 204 disposed side-by-side. As such, this may be how the carrier apparatus 200 is created, wherein cardboard stock may be cut and perforated to form the various separation lines and fold lines necessary to form the constructed embodiment, as illustrated in FIGS. 13A-13F.

As illustrated in FIG. 12, the first body 202 may be separable from second body 204, except along fold line 206 and fold line 208. The first body 202 and the second body 204 may each have several fold lines disposed therein that may be utilized to fold around containers that may be placed within internal spaces created when the carrier apparatus 200 is in its constructed embodiment. As with the embodiments of the carrier apparatuses 10, 100, described above, separate fold lines may be utilized to form either a first internal space or a second internal space, depending on the series of fold lines utilized to form the first or second internal space. Therefore, more or fewer containers may be contained within the first or second internal spaces, respectively.

Figure 13A:
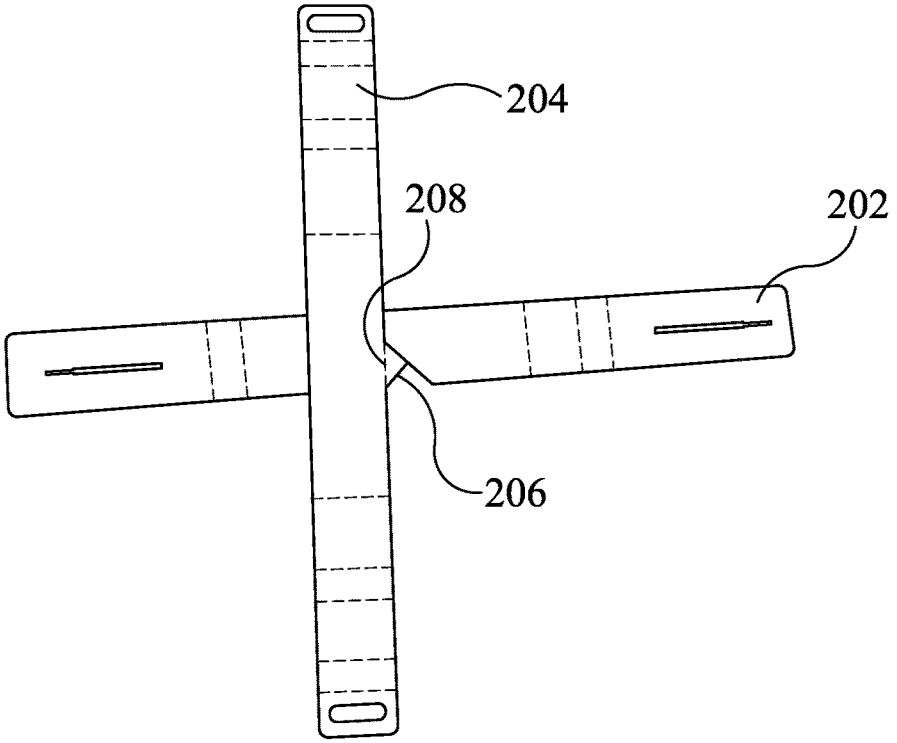
FIGS. 13A-13F illustrate a carrier apparatus transforming from an unassembled configuration to a fully formed configuration.
Figure 13B:
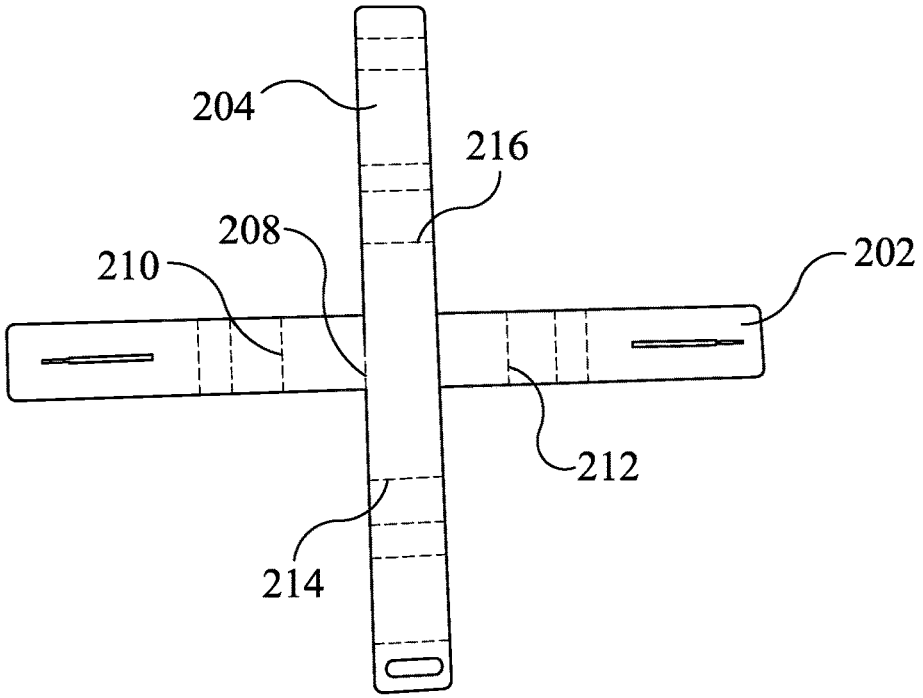

The first body 202 may have fold lines 210, 212 and second body 204 may have fold lines 214, 216, each of which may form a base 218 on which containers may be placed and/or stacked, as illustrated in FIG. 13B. First body 202 may have fold lines 220*a*, 220*b* on a first side 222 of first body 202 and first body 202 may further have fold lines 230*a*, 230*b* on a second side 232 of first body 202. First body 202 may also have a first slot 224 disposed on the first side 222 of the first body 202. The first slot 224 may have a relatively wide portion 226 and a relatively narrow portion 228, which can be used to frictionally hold other elements of the carrier apparatus 200, as described in more detail below. First body 202 may further have second slot 234 disposed on the second side 232 of the first body 202. Second slot 234 may have a relatively side portion 236 and a relatively narrow portion 238, which also can be used to frictionally hold other elements of the carrier apparatus 200, as described in more detail below.

Likewise, second body 204 may have fold lines 240*a*, 240*b* on a first side 242 of the second body 204 and the second body 204 may have further have fold lines 250*a*, 250*b* on a second side 252 of the second body 204. The first side 242 of the second body 204 may further have fold lines 260*a*, 260*b*, wherein fold line 260*a* may have catch slots 262*a*, 262*b* disposed on opposite sides thereof, and fold line 260*b* may have catch slots 264*a*, 264*b* disposed on opposite sides thereof. Further, first side 242 of the second body 204 may have a handle portion 244 disposed therein. Second side 252 of the second body 204 may have fold lines 270*a*, 270*b*, wherein fold line 270*a* may have catch slots 272*a*, 272*b* disposed on opposite sides thereof, and fold line 270*b* may have catch slots 274*a*, 274*b* disposed on opposite sides thereof. First, second side 252 of the second body may have a handle portion 254 disposed therein for matching with handle portion 244 when the carrier apparatus 200 is constructed, as illustrated in FIGS. 13A-13F, described in more detail below.

Figure 13C:
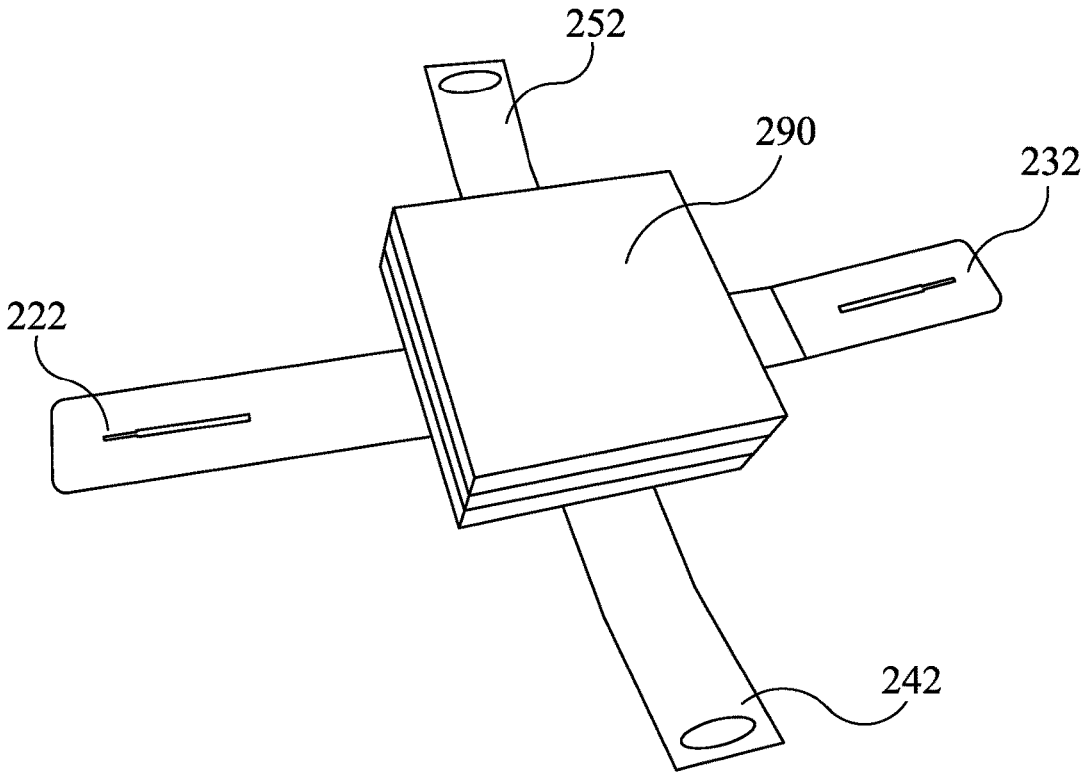

FIGS. 13A-13F illustrate steps for forming or constructing the carrier apparatus 200 into a form that may be utilized to carry one or more containers therein. As illustrated in FIG. 13A, after first body 202 and second body 204 are separated from each other, except along fold lines 206, 208, the fold line 206 may be folded, which causes second body 204 to rotate 90 degrees and be placed atop first body 202. In a second step, illustrated in FIG. 13B, the fold line 208 may be folded along fold line 208 so that the second body 204 is centrally and perpendicularly on first body 202. When disposed in this position illustrated in FIG. 13B, the first body 202 and the second body 204 form the base 218 on which one or more containers may be disposed and/or stacked. Indeed, the base 218 may be the area on the first and second bodies 202, 204 within fold lines 210, 212, 214 and 216, respectively. As illustrated in FIG. 13C, a plurality of pizza boxes 290 may be positioned, although it should be noted that any containers may be disposed thereon and the present invention should not be limited as described herein.

Figure 13D:
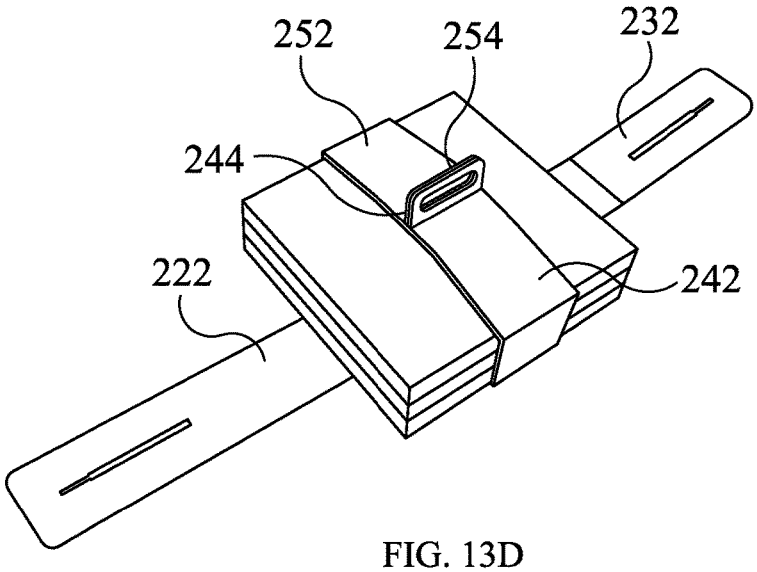

As illustrated in FIG. 13D, first side 242 and second side 252 of the second body, forming wings, may be folded along lines 214, 216, respectively, and again at fold lines 240*a*, 240*b*, respectively, to then meet one another on a top of the boxes 290. When mated thereon, the handle portions 244, 254 may meet as the first and second sides 242, 252 are folded at fold lines 260*b*, 270*b*, respectively. Thus, the first and second sides 242, 252 may wrap around the pizza boxes 290 around the sides and along the top thereof.

Figure 13E:
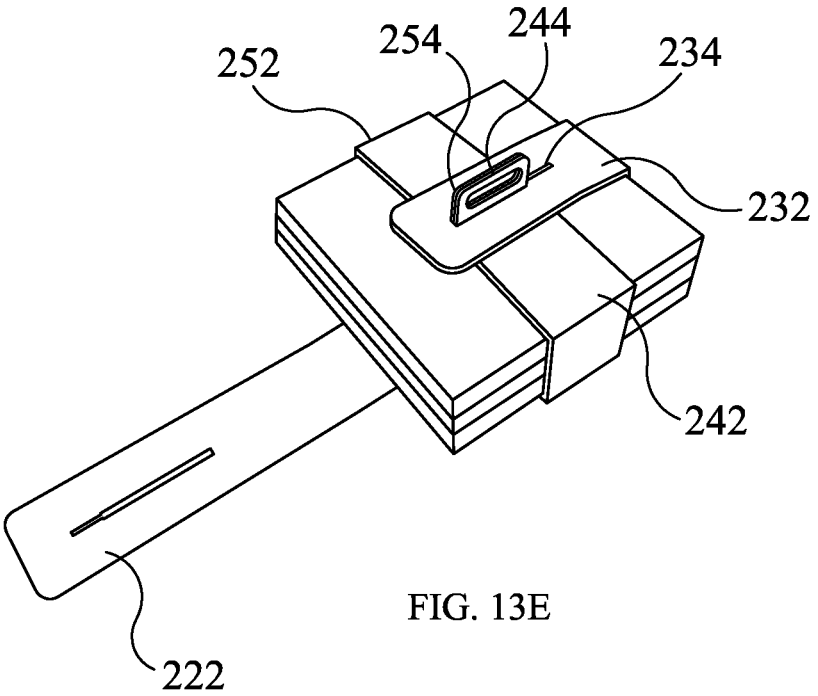

As illustrated in FIG. 13E, second side 232 of first body 202 may be folded at fold line 212 and 230*b* to wrap around the side and along the top of the pizza boxes. The slot 234 may be disposed over the handle portions 244, 254, wherein the handle portions 244, 254 may be disposed through the slot 234. To aid in the positioning of the handle portions 244, 254 through the slot 234, the wide portion 236 of the slot may easily allow the handle portions 244, 254 to slide therethrough, and the narrow portion 238 may frictionally lock the slot onto the handle portions 244, 254. Moreover, an end of the slot 234 may further engage the catch slots 264*b*, 274*b* that may be mated together when handle portions 244, 254 meet holding the second side 232 over the handle portions 244, 254.

Figure 13F:
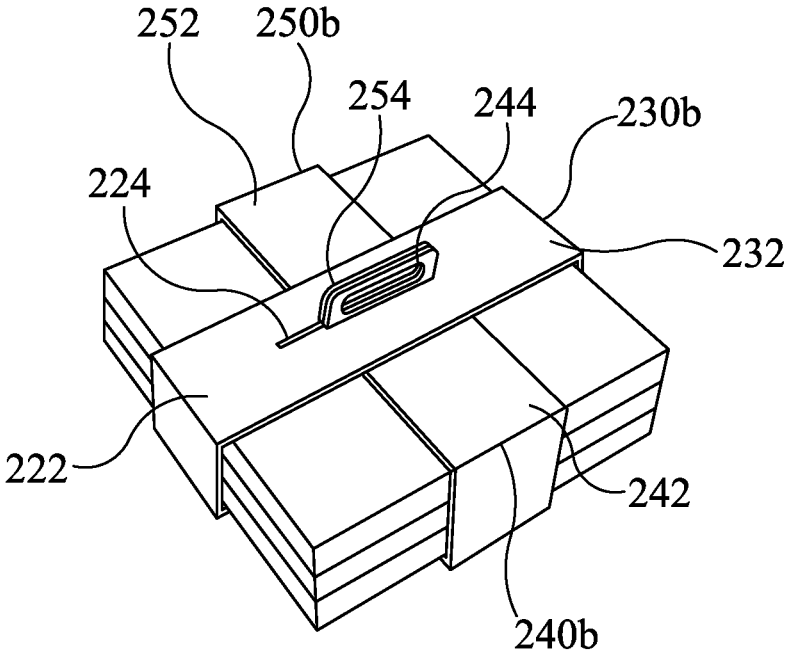

Likewise, as illustrated in FIG. 13F, first side 222 of first body 202 may be folded at fold line 210 and 220*b* to wrap around the side and along the top of the pizza boxes. The slot 224 may be disposed over the handle portions 244, 254, wherein the handle portions 244, 254 may be disposed through the slot 224. To aid in the positioning of the handle portions 244, 254 through the slot 224, the wide portion 226 of the slot may easily allow the handle portions 244, 254 to slide therethrough, and the narrow portion 228 may frictionally lock the slot onto the handle portions 244, 254. Moreover, an end of the slot 224 may further engage the catch slots 264*a*, 274*a* that may be mated together when handle portions 244, 254 meet holding the second side 232 over the handle portions 244, 254.

The above description is apt when a specific sized container or a plurality of containers that fit therein. However, alternate fold lines may be utilized on the first and second bodies 202, 204 to hold a different sized container or different number of containers. Specifically, instead of three pizza boxes 290, as illustrated in FIGS. 13A-13F, only two pizza boxes may cause alternate fold lines 220*a*, 230, 240*a*, 240*b* and 260*a*, 260*b* to be utilized, allowing fewer containers to be disposed therein.

Further, a flap (not shown) may be disposed in one of the bodies 202, 204 that may extend and form a leg or prop that may allow the carrier apparatus 200 to be disposed horizontally when disposed on an inclined surface, such as an automobile seat. Specifically, the flap may be a cut-out having a fold line that may be pushed downwardly to extend from the base 218 (as illustrated in FIG. 13B).

Described herein are two exemplary embodiments showing a plurality of containers that may be held by carrier apparatuses 10 and 100. It should be noted that the shapes of the carrier apparatuses and/or the positions of the fold lines may be changed without detracting from the scope of the present invention, to form various carrier apparatuses for additional types, sizes, shapes, etc. of containers, and the present invention should not be limited as described herein.

The carrier apparatuses 10 and 100, as noted above, may be made via any manufacturing method, including but not limited to, die cutting, laser scoring, or other like manufacturing techniques. Preferably, the carrier apparatus 10 may be made from a flat sheet of cardboard or corrugated fiber board that has strategically placed cut lines and fold lines disposed therein to create the functionality described herein.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

The invention claimed is:

1. A carrier apparatus for carrying items comprising:

a base panel section;

a first wing extending from a first side of the base panel section, the first wing having a first notch and a second notch;

a second wing extending from a second side of the base panel section, the second wing having a first notch and a second notch; and a first slotted lock flap extending from a third side of the base panel section comprising a slot, wherein the first wing and the second wing are each foldable upwardly roughly perpendicular at a first fold line disposed in each of the first wing and the second wing, and further wherein the first wing and the second wing are each foldable towards each other along a second fold line disposed in each of the first wing and the second wing, and further wherein the first wing and the second wing are each foldable at a third fold line in each of the first wing and the second wing wherein folding the first wing and the second wing upwardly roughly perpendicularly at the third fold line aligns the first wing and the second wing adjacent each other above the third fold line, wherein when the first wing and the second wing are adjacent each other above the third fold line, the first notch in the first wing and the first notch in the second wing align with each other to form a first catch slot, wherein folding the first wing and the second wing at the first fold lines, the second fold lines, and the third fold lines in the first and second wings and engaging the first catch slot with an edge of the slot in the first slotted lock flap forms a first internal space having a first volume, and further wherein the first wing and the second wing are each foldable towards each other at a fourth fold line disposed in each of the first wing and the second wing, and further wherein the first wing and the second wing are each foldable at a fifth fold line disposed in each of the first wing and the second wing wherein folding the first wing and the second wing upwardly roughly perpendicular at the fifth fold line aligns the first wing and the second wing adjacent each other above the fifth fold line, wherein when the first wing and the second wing are adjacent each other above the fifth fold line, the second notch in the first wing and the second notch in the second wing align with each other to form a second catch slot, wherein folding the first wing and the second wing at the first fold lines, the fourth fold lines, and the fifth fold lines in the first and second wings and engaging the second catch slot with an edge of the slot in the first slotted lock flap forms a second internal space having a second volume.

2. The carrier apparatus of claim 1 wherein the second volume is larger than the first volume.

3. The carrier apparatus of claim 1 wherein the first fold lines of the first and second wings are disposed in the first and second wings at the location wherein the first and second wings extend from the base panel section.

4. The carrier apparatus of claim 1 wherein the second fold lines of the first and second wings are configured to fold the first and second wings roughly horizontally when the first and second wings are disposed upwardly due to the folding of the first and second wings at the first fold lines.

5. The carrier apparatus of claim 1 wherein the base panel section is triangular.

6. The carrier apparatus of claim 1 wherein the base panel section is a four-sided parallelogram.

7. The carrier apparatus of claim 1 further comprising a flap extending from a bottom surface of the base panel section.

8. The carrier apparatus of claim 1 further comprising:

a second slotted lock flap extending from a fourth side of the base panel section.

9. The carrier apparatus of claim 8 wherein the first internal volume is formed by engaging the first and second wings with both the first slotted lock flap and the second slotted lock flap.

10. The carrier apparatus of claim 9 wherein portions of both the first and second wings are disposed through the slot in the first slotted lock flap and a slot in the second slotted lock flap.

11. The carrier apparatus of claim 1 comprising:

a handle extending from at least one of the first and second wings.

12. The carrier apparatus of claim 11 wherein the first and second wings each comprise a cut-out portion, such that the cut-out portions of the first and second wings form the handle together.

13. The carrier apparatus of claim 1 further comprising:

a flap extending from a side of the first internal volume wherein the flap is configured to open a window through which a portion of a container is disposed when contained within the first internal volume.

14. The carrier apparatus of claim 1 wherein the base panel section is formed from overlapping base panel section portions that are disposed roughly perpendicular to each other.

* * * * *